US006764026B2

(12) United States Patent
Hunter et al.

(10) Patent No.: US 6,764,026 B2
(45) Date of Patent: Jul. 20, 2004

(54) PROCESS FOR SPRAYING ONE-COMPONENT COMPOSITIONS WITH AIR-ASSISTED, LOW PRESSURE EQUIPMENT HAVING AN IMPROVED SPRAY NOZZLE

(75) Inventors: Jack H. Hunter, Coraopolis, PA (US); Edward P. Squiller, Bridgeville, PA (US)

(73) Assignee: Bayer Polymers LLC, Pittsburgh, PA (US)

( * ) Notice: Subject to any disclaimer, the term of this patent is extended or adjusted under 35 U.S.C. 154(b) by 251 days.

(21) Appl. No.: 10/028,893

(22) Filed: Dec. 18, 2001

(65) Prior Publication Data

US 2003/0111553 A1 Jun. 19, 2003

(51) Int. Cl.[7] ..... A62C 31/00; B05B 1/28

(52) U.S. Cl. ..... 239/398; 239/290; 239/291; 239/296; 239/304

(58) Field of Search ..... 239/398, 8, 290, 239/291, 296, 302, 303, 304, 353, 378, 401, 406, 527, 526, 569, 924; 222/325, 326, 137, 145, 135, 327, 145.6

(56) References Cited

U.S. PATENT DOCUMENTS

| | | | | | |
|---|---|---|---|---|---|
| 5,104,005 | A | * | 4/1992 | Schneider et al. | 222/137 |
| 5,184,758 | A | * | 2/1993 | Keller | 222/137 |
| 5,310,091 | A | * | 5/1994 | Dunning et al. | 222/135 |
| 5,536,531 | A | * | 7/1996 | Owen et al. | 427/256 |
| 6,062,492 | A | * | 5/2000 | Tudor et al. | 239/296 |
| 6,488,991 | B1 | * | 12/2002 | Hunter et al. | 427/421 |
| 6,572,031 | B2 | * | 6/2003 | Hunter et al. | 239/290 |

OTHER PUBLICATIONS

Ratio–Pak® Cartridge System is manufactured by Plas–Pak Industries, Inc. (date unavailable).
130 Series, Spiral™ Mixer Sanitary design (date unavailable).
TAH Industries, Inc. Catalog 110, May 2000, Motionless Mixers for Adhesives and Sealants pp. 3–16.
Cox North America, Inc. (COX) Quality Sealant Applicators—Worldwide (date unavailable).

* cited by examiner

*Primary Examiner*—Davis Hwu
(74) *Attorney, Agent, or Firm*—Joseph C. Gil; Thomas W. Roy; Gary F. Matz

(57) ABSTRACT

The present invention relates to a process for spraying a one-component composition by a) activating the trigger mechanism of a caulking gun having two or more rams and containing two or more cartridges to incrementally advance a ram into operative engagement with each cartridge and dispense a first liquid binder component from a first cartridge and a second liquid additive component from a second cartridge into a static mixer having an optionally removable spray tip,
b) mixing the first component and the second component in the static mixer,
c) discharging the mixed liquid components from the static mixer through the optionally removable spray tip at the downstream end of the static mixer into an atomizing zone,
d) introducing air into the atomizing zone,
e) atomizing the mixed liquid components in the atomizing zone,
f) spraying the atomized liquid components onto a substrate and
g) during an interruption in the spraying process or after termination of the spraying process, discarding the static mixer and the optionally removable spray tip.

20 Claims, 2 Drawing Sheets

1
2
3
4
5
6
7
8
9
10
11
12
13
14
15
16
17
19
20
21
23
24

PROCESS FOR SPRAYING ONE-COMPONENT COMPOSITIONS WITH AIR-ASSISTED, LOW PRESSURE EQUIPMENT HAVING AN IMPROVED SPRAY NOZZLE

BACKGROUND OF THE INVENTION

1. Field of the Invention

The present invention relates to a process for spraying a one-component coating, sealing or adhesive composition using air-assisted, low pressure spray equipment having an improved spray nozzle.

2. Description of the Prior Art

One-component coating, sealing or adhesive compositions are known and include isocyanate-terminated and alkoxysilane-terminated resins or prepolymers that cure in the presence of atmospheric moisture. Also known are mixtures of isocyanate-terminated resins and blocked co-reactants that are activated in the presence of moisture, such as aldimines, ketimines and oxazolidines. Depending upon the particular application these one-component compositions are often mixed with solvents, pigments or other additives that may not be entirely free of moisture. Any moisture present in these additives can cause premature polymerization of the compositions reducing their storage stability.

It is also known in the prior art to employ processes for reducing the moisture content of the additives prior to blending them with the reactive component. Examples include the addition of moisture scavengers, which are often added in excess amount, based on the moisture present, to ensure complete removal of moisture. However, many of the moisture scavengers also have to removed or neutralized due to their volatility. Due to the steps involved and the amount of time necessary, these existing methods are costly.

While it is possible to mix the reactive components with the additives just prior to use, it is critical that the components are mixed in the right proportions. If the components are mixed in the wrong proportions, then the properties of the resulting products can be substantially affected. Special metering and mixing equipment is often needed to conduct this process on a commercial scale, which is also costly.

Accordingly, it is an object of the present invention to provide a process for mixing the binders for one-component compositions with additives without the need for expensive moisture removal steps. It is an additional object of the present invention to accurately mix the components.

This object may be achieved with the process according to the present invention which utilizes a low pressure, air-assisted spray system to accurately mix the components of the one-component spray according to the present invention. An important feature of the invention is the use of a disposable spray tip and static mixer to accurately mix the binders and additives of the one-component systems. Another important feature of the present invention is the use of an optionally power-assisted caulking gun to deliver the one-component composition to the spray tip.

Copending applications, U.S. Ser. Nos. 09/838,792 and 09/838,794, disclose the use of a disposable spray tip and static mixer in combination with a low pressure, two-component, air-assisted spray system. However, that system is intended for larger applications and does not disclose the use of a caulking gun to deliver the two-component composition. Copending applications, U.S. Ser. Nos. 09/917,309 and 09/917,298, describe the use of a caulking gun to deliver two-component compositions to a static mixer having an optionally removable spray tip. These applications do not disclose mixing the binder for a one-component composition with one or more additives. Copending application, Attorney's Docket No. MD-01-83A-LS, describes the use of a caulking gun to mix the binder for a one-component composition with one or more additives, but in that application the static mixer is inserted into a shroud.

SUMMARY OF THE INVENTION

The present invention relates to a process for spraying a one-component composition by a) activating the trigger mechanism of a caulking gun having two or more rams and containing two or more cartridges to incrementally advance a ram into operative engagement with each cartridge and dispense a first liquid binder component from a first cartridge and a second liquid additive component from a second cartridge into a static mixer having an optionally removable spray tip,
b) mixing the first component and the second component in the static mixer,
c) discharging the mixed liquid components from the static mixer through the optionally removable spray tip at the downstream end of the static mixer into an atomizing zone,
d) introducing air into the atomizing zone,
e) atomizing the mixed liquid components in the atomizing zone,
f) spraying the atomized liquid components onto a substrate and
g) during an interruption in the spraying process or after termination of the spraying process, discarding the static mixer and the optionally removable spray tip.

DETAILED DESCRIPTION OF THE INVENTION

Figures 1, 2:
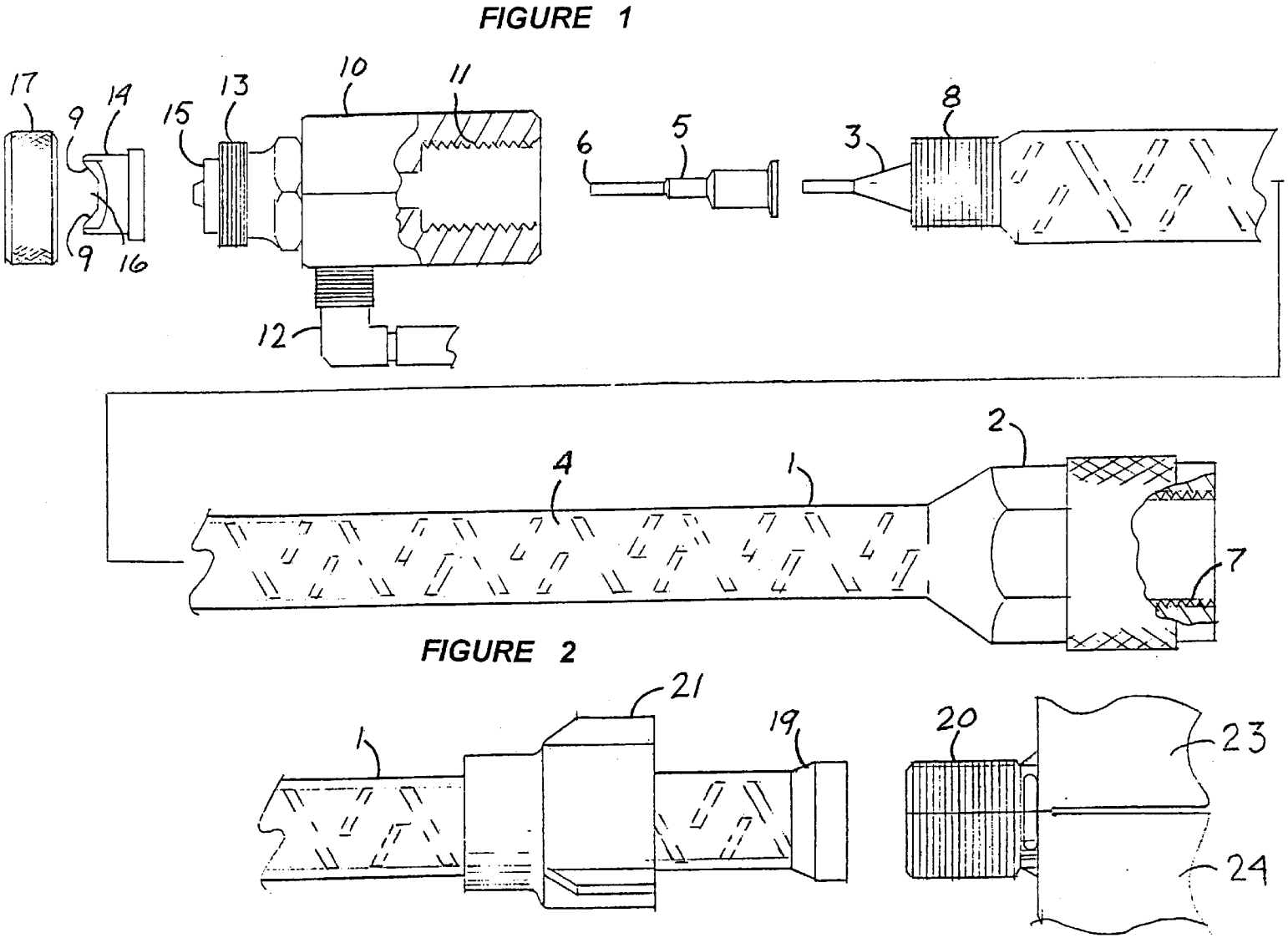
FIG. 1 represents an exploded view of a preferred embodiment of the spray nozzle according to the invention.
FIG. 2 represents another embodiment of the static mixer according to the invention.

The air-assisted, low pressure spray equipment for spraying the one-component compositions in accordance with the present invention includes 1) a caulking gun having a carriage adapted to receive two or more cartridges having a nozzle, two or more rams mounted on the caulking gun for operatively engaging each cartridge to dispense a liquid component from the nozzle of the cartridge, a trigger mechanism for manually, pneumatically, hydraulically or electrically advancing the rams incrementally into operative engagement with each cartridge,
2) a static mixer having an upstream end and a downstream end wherein
   a) the upstream end has an inlet port for receiving a liquid component from the nozzle of each cartridge and the upstream end is dimensioned to be reversibly connected to the cartridges of the caulking gun, and
   b) the downstream end has an optionally removable spray tip for introducing the mixed liquid components into an atomizing zone and the downstream end is dimensioned for reversibly connecting the static mixer to a spray section, and 3) a spray section having an upstream end and a downstream end wherein a) the upstream end of the spray section is dimensioned for being reversibly connecting to the static mixer, b) the spray section has inlet ports for receiving pressurized air and c) the downstream end of the spray section has outlet ports for introducing air into an atomizing zone formed between the outlet ports and the spray tip, wherein the spray tip of the static mixer passes through an orifice in the spray section such that the mixed liquid components are introduced into the atomizing zone.

The caulking gun may be operated manually or preferably may be driven pneumatically, hydraulically or with an electric motor to more accurately and easily dispense two or more liquid components into a static mixer connected to the discharge end of the caulking gun.

The rams of the pneumatic or hydraulic caulking guns may be driven, e.g., by compressed air or a liquid such as water, which drives a piston connected to the ram. The rams of the electric caulking guns are driven by an electric motor, which either rotates a screw or worm drive to drive the ram. Any known caulking guns are suitable for dispensing the liquid components according to the present invention. Examples of manual and pneumatic caulking guns are available from Cox North America. One advantage of using pneumatic caulking guns is that the same compressed air source used to drive the ram can be used to provide air to the spray system to be described hereinafter.

The caulking guns may be used for dispensing materials from two or more cartridges. Different mix ratios can be obtained by either using different size cartridges or by adjusting the rams for each cartridge to advance at different speeds, e.g., by using separate drive mechanisms. Another possibility for obtaining different mix ratios is to use more than one cartridge containing one of the liquid components. Preferably, different mix ratios are obtained by using different size cartridges for the components.

Examples of these cartridges include the Ratio-Pak cartridges from Plas-Pak Industries. Another advantage of these cartridges is that their nozzles are threaded and designed to be attached to the disposable static mixers described hereinafter. When using two cartridges the two nozzles fit together to form a threaded end that can be attached to the disposable static mixer.

It is also possible in accordance with the present invention to overcome the problem of clogging in the static mixer, the spray tip and/or air entry ports when spraying reactive compositions. This is accomplished by using a removable static mixer having an optionally removable spray tip at the downstream end. In one embodiment the static mixer tapers at the downstream end to form a spray tip. In a preferred embodiment a removable spray tip is attached to the downstream end of the static mixer. In accordance with this preferred embodiment different size spray tips can be attached to control the volume of material to be sprayed.

The static mixers can be made of metal or plastic or other suitable materials. They are preferably made from plastic for cost reasons because at the completion of the spraying process or during periods when the spraying process is interrupted, the static mixer and the optionally removable spray tip are removed and discarded. However, the pressure limitations of the static mixers should not be exceeded. Accordingly, when operating at higher pressures, it may be necessary to use metal or other specially designed static mixers that can withstand the operating pressure.

Examples of suitable static mixers are available as motionless mixers from Tah Industries. Examples include stainless tube mixers, stainless pipe mixers, stainless/plastic pipe mixers and plastic tube mixers. Removable spray tips are also available from Tah Industries as Luer lock fitting needles.

In accordance with the present invention the upstream end of the static mixer is dimensioned to be reversibly connected to the caulking gun, preferably to the cartridges inserted into the caulking gun, and the downsteam end of the static mixer is dimensioned to be reversibly connected to the spray section. The type of connection is not critical, provided that the connection is reversible so that the static mixer and the optionally removable spray tip can be discarded. Suitable connections include threads, clamps, retaining rings and quick connectors.

In one embodiment, which is shown in FIG. 1, the upstream end of the static mixer is threaded so that it can be attached to the threaded end of the cartridges extending from the caulking gun. In another embodiment, which is shown in FIG. 2, the upstream end of the static mixer is flared so that it can be held against the caulking gun by a retaining ring, preferably a threaded retaining ring.

The upstream end of a conventional spray section having an atomizing zone is connected to the downstream end of the static mixer. Both ends are dimensioned to be reversibly connected to each other. This connection can be the same as those set forth previously for connecting the upstream end of the static mixer to the caulking gun cartridges. The spray tip extends through an orifice in the rear portion of the spray section and into the atomizing zone.

Figure 4:
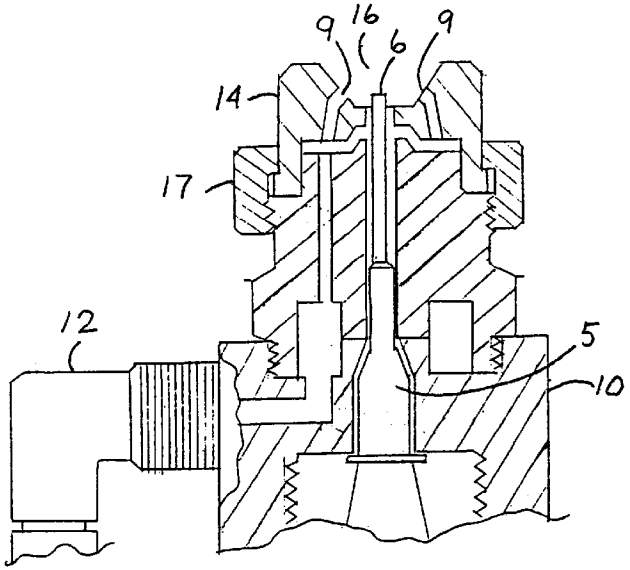
FIG. 4 represents an enlarged view of the spray section of the spray nozzle.

After the components are mixed in the static mixer they are introduced into the atomizing zone of the spray section where they are atomized with air, which may stored in compressed gas cylinders or produced continuously in known manner in a compressor. Methods of atomizing the liquid components with air for spraying are well known and are not critical to the present invention. In a preferred embodiment as shown in FIG. 4, the mixed liquid components are passed generally perpendicularly past two or more opposed air outlet ports. Depending upon the arrangement of these ports to the mixed components a flat or conical spray pattern can be controlled in known manner.

Air may also be introduced through the same orifice in the spray section that the spray tip passes through. In this embodiment the air passes on the outside of the spray tip parallel to the mixed components. However, less atomization occurs according to this embodiment. It is also possible to introduce air at other angles to the liquid components that range from parallel to perpendicular or slightly greater.

In accordance with the process of the present invention the liquid components are preferably introduced into the static mixer at a pressure of 2 to 100 bar, more preferably 5 to 70 bar and most preferably 10 to 50 bar, which is supplied by the caulking gun. The components are then mixed in the static mixer and discharged through the optionally removable spray tip at the downstream end of the static mixer into an atomizing zone. Air is also introduced into the atomizing zone at a pressure of preferably 0.5 to 10 bar, preferably 1 to 7 bar and more preferably 3 to 6 bar. The atomized liquid components are then applied to a suitable substrate.

Suitable binders for the one-component compositions include both fully reacted polymers and resins or prepolymers containing terminal groups capable of further reaction. Examples of fully reacted polymers include such as polyurethanes, polyesters, polyacrylates, polyamides and polychloroprenes. Examples of reactive resins include isocyanate-terminated prepolymers and alkoxysilane-terminated prepolymers, which can be further reacted or chain extended in the presence of moisture. Other examples include mixtures of isocyanate-terminated resins and blocked co-reactants that are activated in the presence of moisture, such as aldimines, ketimines and oxazolidines.

Also suitable are polymers containing unsaturated groups, which can be cured or crosslinked by UV radiation or by mixing with peroxides, and oxidatively drying resins, such as alkyd resins, which cure in the presence of drying agents or siccatives.

Also suitable are one-component compositions containing a liquid component and a solid component that is inert to the liquid component in solid form, but can be activated, e.g., by the addition of a solvent, which dissolves the solid component. Examples of these one-component systems include polyols that contain solid polyisocyanates in the form of discrete particles in which the surface has been deactivated. Examples of suitable polyisocyanates and are disclosed in U.S. Pat. No. 4,701,480, herein incorporated by reference polyols are disclosed in U.S. Pat. No. 4,701,480, herein incorporated by reference.

Examples of additives include the known additives from polymer chemistry, such as levelling agents, UV stabilizers and antioxidants. Especially preferred are additives that could affect the storage stability of the binders, such as catalysts, pigments, fillers, plasticizers, solvents, peroxides for curing unsaturated resins and siccatives for curing oxidatively drying resins.

An additional advantage of having the pigment present in a separate cartridge is that it is easier to change the color of the composition since it is not necessary to maintain an inventory of each pigment blended with the binder. This latter advantage can also be useful with fully reacted polymers and also with one-component systems that contain two reactive components, such as blocked polyisocyanates and polyols or isocyanate-terminated prepolymers and aldimines, ketimines and/or oxazolidines.

In accordance with the present invention the binders, i.e., the reactive components of the one-component compositions are present in one cartridge and the additives, i.e., the non-reactive components are preferably present in a separate cartridge, especially when the additives can affect the storage stability of the one-component compositions. Examples include the presence of catalysts or water-containing additives for binders that cure in the presence of moisture and peroxides for initiating the free radical polymerization of unsaturated resins and siccatives for curing oxidatively drying resins.

FIG. 1 represents a preferred embodiment of the present invention. Static mixer 1 has threaded end 2 for receiving the one-component composition and tapered end 3 for receiving removable spray tip 5. Static mixer 1 has internal mixing unit 4 for homogeneously mixing the two-component composition. Spray tip 5 has an end 6.

Static mixer 1 and spray tip 5 are inserted through spray section 10 such that end 6 extends into atomizing zone 16. Static mixer 1 has threaded end 7 for attaching to the cartridges of a caulking gun and threaded end 8 for connecting to spray section 10. Air is introduced into atomizing zone 16 via tube 12 through outlet ports in modified fluid nozzle 15 and through outlet ports 9 in air cap 14. Air cap 14 is held against the modified fluid nozzle 15 by attaching threaded retaining ring 17 to threads 13 of spray section 10. In atomizing zone 16, the air passing through outlet ports 9 atomizes the liquid stream of the one-component coating composition passing through static mixer 1 and end 6 of spray tip 5.

FIG. 2 shows an alternative embodiment in which static mixer 1 has a flared end 19 which is held against threaded end 20 of cartridges 23 and 24 of caulking gun 18 by retaining ring 21.

Figure 3:
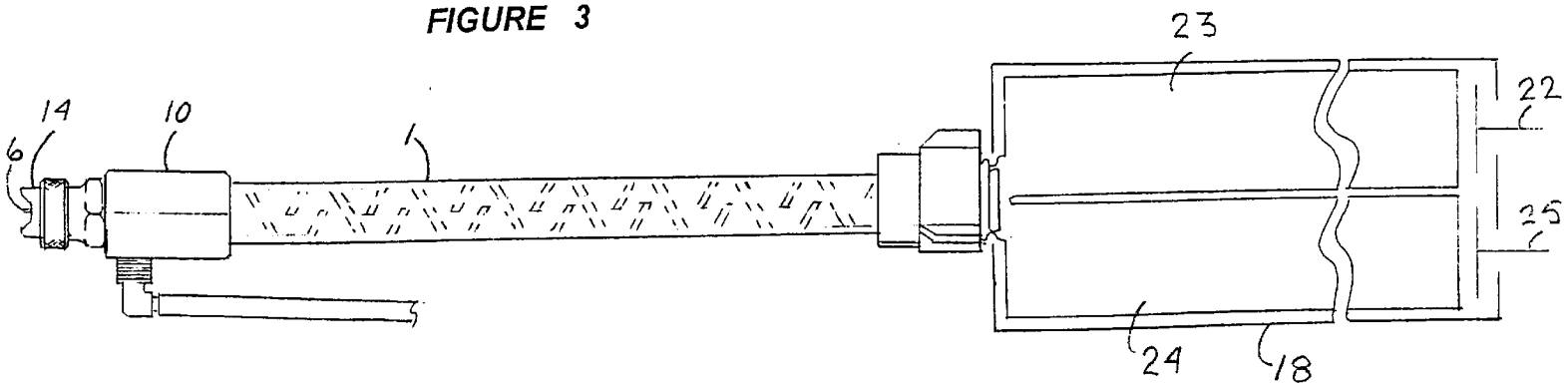
FIG. 3 represents an embodiment of the spray nozzle connected to the cartridges of a caulking gun.

FIG. 3 shows a preferred embodiment of the spray nozzle according to the invention that has been connected to cartridges 23 and 24 of caulking gun 18. The reactive and additive components, which are contained in cartridges 23 and 24, are delivered under pressure by rams 22 and 25 into static mixer 1. Threaded end 20 of cartridges 23 and 24 is attached to threaded end 7 of static mixer 1. The components are mixed in static mixer 1 and then pass through spray tip 5 and end 6 into the atomizing zone 16. The narrowed end 6 of spray tip 5 extends beyond the base of air cap 14.

FIG. 4 shows an enlargement of a preferred embodiment of spray section 10. Spray tip 5 extends through spray section 10 such that end 6 passes through an orifice in air cap 14, which is held onto the end of spray section 10 by retaining ring 17. Air enters the upper portion of spray section 10 through tube 12 and passes through outlet ports in modified fluid nozzle 15 and through outlet ports 9 in air cap 14 into atomizing zone 16.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A process for spraying a one-component composition which comprises a) activating the trigger mechanism of a caulking gun having two or more rams and containing two or more cartridges to incrementally advance a ram into operative engagement with each cartridge and dispense a first liquid binder component from a first cartridge and a second liquid additive component from a second cartridge into a static mixer having an optionally removable spray tip, b) mixing the first component and the second component in the static mixer, c) discharging the mixed liquid components from the static mixer through the optionally removable spray tip at the downstream end of the static mixer into an atomizing zone, d) introducing air into the atomizing zone, e) atomizing the mixed liquid components in the atomizing zone, f) spraying the atomized liquid components onto a substrate and g) during an interruption in the spraying process or after termination of the spraying process, discarding the static mixer and the optionally removable spray tip.

2. The process of claim 1 wherein said first liquid binder component comprises a resin containing terminal isocyanate groups.

3. The process of claim 1 wherein said first liquid binder component comprises a resin containing terminal alkoxysilane groups.

4. The process of claim 1 wherein said first liquid binder component comprises a polyurethane resin.

5. The process of claim 1 wherein the first liquid binder component comprises a polymer containing unsaturated groups.

6. The process of claim 1 wherein said second liquid additive component comprises a pigment.

7. The process of claim 2 wherein said second liquid additive component comprises a pigment.

8. The process of claim 3 wherein said second liquid additive component comprises a pigment.

9. The process of claim 4 wherein said second liquid additive component comprises a pigment.

10. The process of claim 5 wherein said second liquid additive component comprises a pigment.

11. The process of claim 1 wherein said second liquid additive component comprises a catalyst.

12. The process of claim 2 wherein said second liquid additive component comprises a catalyst.

13. The process of claim 3 wherein said second liquid additive component comprises a catalyst.

14. The process of claim 5 wherein said second liquid additive component comprises a peroxide initiator for unsaturated groups.

15. The process of claim 1 wherein said second liquid additive component comprises a solvent.

16. The process of claim 2 wherein said second liquid additive component comprises a solvent.

17. The process of claim 3 wherein said second liquid additive component comprises a solvent.

18. The process of claim 4 wherein said second liquid additive component comprises a solvent.

19. The process of claim 1 wherein said first liquid binder component comprises an oxidatively drying resin and said second liquid additive component comprises a siccative.

20. The process of claim 15 wherein said first liquid binder component comprises a polyol containing a surface-deactivated, solid polyisocyanate in the form of discrete particles.

* * * * *